United States Patent [19]

Hayashi et al.

[11] Patent Number: 4,838,233

[45] Date of Patent: Jun. 13, 1989

[54] PILOT INJECTION SYSTEM FOR FUEL INJECTION PUMP

[75] Inventors: Satoshi Hayashi, Nagoya; Masahiro Tomita, Anjo; Hitoshi Niwa; Hirokatsu Mukai, both of Okazaki, all of Japan

[73] Assignee: Nippondenso Co., Ltd., Kariya, Japan

[21] Appl. No.: 268,659

[22] Filed: Nov. 8, 1988

Related U.S. Application Data

[63] Continuation of Ser. No. 21,331, Mar. 3, 1987, abandoned.

[30] Foreign Application Priority Data

Mar. 5, 1986 [JP] Japan ..... 61-47713

[51] Int. Cl.[4] ..... F02M 39/00

[52] U.S. Cl. ..... 123/506; 123/498; 123/300

[58] Field of Search ..... 123/506, 498, 500, 501, 123/299, 300, 458

[56] References Cited

U.S. PATENT DOCUMENTS

| | | | |
|---|---|---|---|
| 4,385,614 | 5/1983 | Eheim | 123/506 |
| 4,530,337 | 7/1985 | Laufer | 123/300 |
| 4,586,480 | 5/1986 | Kobayashi | 123/506 |
| 4,643,155 | 2/1987 | O'Neill | 123/506 |
| 4,660,523 | 10/1985 | Bauer | 123/498 |
| 4,730,585 | 3/1988 | Abe | 123/506 |
| 4,782,803 | 11/1988 | Kikuchi | 123/500 |
| 4,782,807 | 11/1988 | Takahashi | 123/506 |

FOREIGN PATENT DOCUMENTS

| | | | |
|---|---|---|---|
| 3437053 | 6/1985 | Fed. Rep. of Germany | 123/300 |
| 0152161 | 9/1983 | Japan | 123/498 |
| 59-18249 | 1/1984 | Japan . | |

*Primary Examiner*—Carl Stuart Miller

*Attorney, Agent, or Firm*—Cushman, Darby & Cushman

[57] ABSTRACT

A pilot injection system according to the present invention, which is used in a fuel injection pump, has a casing attached to the pump. The casing connects internally with a pump chamber of the injection pump. A partition wall is fixed in the casing, whereby the pump chamber is divided from the inside of the casing. A movable wall, which is movably located in the casing, divides the inside space of the casing between a fuel-spill chamber and a holding chamber. The partition wall is formed with a valve hole, which connects the pump chamber and the spill chamber. The valve hole has a seat surface which faces the pump chamber. A valve plug, which is located in the pump chamber, can be seated on the seat surface. The valve plug is connected to the movable wall by means of a coupling rod, which extends through the valve hole. Located in the spill chamber is a return spring which urges the movable wall in a direction such that the valve plug closes the valve hole. Moreover, an actuator for moving the movable wall is disposed in the holding chamber of the casing. The actuator includes a stack of piezoelectric elements, which can extend or contract in accordance with a voltage applied thereto.

7 Claims, 2 Drawing Sheets

PILOT INJECTION SYSTEM FOR FUEL INJECTION PUMP

This is a continuation of application Ser. No. 07/021,331, filed Mar. 3, 1987, which was abandoned upon the filing hereof.

BACKGROUND OF THE INVENTION

The present invention relates to a pilot injection system used in a fuel injection pump, and more specifically, to a pilot injection system in which a stack of piezoelectric elements is used as an actuator.

In general, diesel engines of automobiles, during idle running, produce higher levels of noise and vibration than gasoline engines. It is well-known, however, that the levels of noise and vibration of diesel engines can be lowered by performing pilot injection before the main injection of fuel into the combustion chambers of the engine.

Therefore, fuel injection pumps for diesel engines are commonly expected to be able to perform pilot injection, as well as main injection. One such fuel injection pump is stated in Japanese Patent Disclosure No. 59-18249. This prior art pump has a pump chamber which is supplied with fuel. The fuel in the pump chamber is pressurized by a plunger. The pressurized fuel is injected through injection nozzles into the combustion chambers of the engine. Also, the pump has a pressure chamber which is connected to the pump chamber. The pressure chamber is defined by a piston, which is coupled with a stack of piezoelectric elements, for use as an actuator. The stack tends to extend or contract, depending on the value of the voltage applied thereto. In the fuel injection pump of this type, after the pressurized fuel in the pump chamber starts to be injected into the combustion chambers of the engine, the fuel pressure in the pump chamber, which is connected to the pressure chamber, is lowered instantaneously when the piston is moved by contraction of the stack, thereby increasing the capacity of the pressure chamber. As a result, the internal fuel pressure of the pressure chamber temporarily becomes lower than the opening pressure of the injection nozzles. Thus, the fuel injection into the combustion chambers is stopped for a while, permitting the pilot injection.

In the fuel injection pump having the pilot injection system of the aforementioned construction, it is evident that the change of capacity of the pump chamber, which is conducive to the pilot injection, depends on the degree of contraction of the stack. However, the stack contracts to only a relatively low degree. With use of the conventional pilot injection system, therefore, the pilot injection cannot be separated definitely from the main injection subsequent thereto. Thus, the desired pilot injection cannot be ensured with ease. On the other hand, the stack can be contracted to the desired degree if it is increased in size. In such a case, however, the injection system itself must be large-sized.

In the prior art pilot injection system, moreover, even while the engine is operating at high speed, without requiring pilot injection, the high fuel pressure in the pump chamber is directly applied through the piston to the stack. Therefore, the piezoelectric elements of the stack are liable to be damaged after prolonged use.

SUMMARY OF THE INVENTION

The object of the present invention is to provide a pilot injection system, which can securely effect pilot injection by varying the internal pressure of a pump chamber of a fuel injection pump, without regard to the degree of extension or contraction of a stack of piezoelectric elements, and can prevent the high pressure inside the pump chamber from being applied directly to the stack, in case of the pilot injection being unnecessary.

The above object of the invention is achieved by a pilot injection system for a fuel injection pump, which has a pump chamber and supplies a pressurized fuel in the pump chamber to a combustion chamber of an internal combustion engine through an injection nozzle, the injection system comprising a casing attached to the fuel injection pump, the inside of the casing communicating with the pump chamber of the pump; a partition wall provided in the casing and dividing the pump chamber and the inside of the casing in a liquid-tight manner; a movable wall disposed in the casing and dividing the inside of the casing between a fuel-spill chamber, situated closer to the pump chamber and connected to the low-pressure side, and a holding chamber situated farther from the pump chamber; a valve unit for controlling the connection between the pump chamber and the fuel-spill chamber, the valve unit including a valve hole formed in the partition wall and connecting the pump chamber and the fuel-spill chamber, the valve hole having a seat surface facing the pump chamber, a valve plug adapted to be seated on the seat surface, thereby closing the valve hole, a coupling rod attached to the valve plug, extending through the valve hole into the fuel-spill chamber, and coupled to the movable wall, and a return spring located between the movable wall and the partition wall and pressing the movable wall toward the holding chamber, whereby the valve plug is seated on the seat surface of the valve hole, by means of the movable wall and the coupling rod, urged by the return spring; and an actuator disposed in the holding chamber of the casing and serving to operate the valve plug, the actuator including a stack of piezoelectric elements, coupled to the movable wall and capable of extending or contracting in accordance with a voltage applied to each piezoelectric element, so that the valve plug is lifted from the seat surface of the valve hole, against the urging force of the return spring, through the medium of the movable wall and the rod, when the stack extends.

According to the pilot injection system of the present invention, if the stack of the actuator is extended when the pressurized fuel in the pump chamber of the fuel injection pump starts to be injected from the pump chamber into the combustion chamber of the engine, through the injection nozzle, the valve plug is lifted from the seat surface of the valve hole by means of the movable wall and the coupling rod, thereby opening the valve hole. Thereupon, the high-pressure fuel in the pump chamber escapes into the fuel-spill chamber, so that the internal pressure of the pump chamber drops sharply to a level below the opening pressure of the injection nozzle. Thus, the fuel injection from the injection nozzle is stopped, whereupon the pilot injection ends.

Thereafter, the stack is contracted to its original state, and the valve hole is closed by means of the valve plug. Thereupon, the fuel in the pump chamber starts again to be pressurized, so that the fuel pressure in the pump chamber rises above the level of the valve opening pressure of the injection nozzle. As a result, the fuel starts again to be injected from the injection nozzle, thus effecting the main injection.

Thus, according to the pilot injection system of the present invention, the pilot injection can be effected by causing the fuel in the pump chamber to escape into the fuel-spill chamber by means of the valve unit. Therefore, the changing rate of the capacity of the pump chamber, that is, the depressurization rate of the fuel in the pump chamber, depends not on the degree of extension of the stack, but on the valve-opening time of the valve hole of the valve unit. In consequence, in the pilot injection system of the invention, the valve unit can be opened securely to effect satisfactory pilot injection, even though the stack extends only slightly.

If the pilot injection is unnecessary, the valve unit need not be operated. In this case, the fuel pressure in the pump chamber is applied to the partition wall through the medium of the valve plug. The valve plug, which is subjected to the pressure from the pump chamber, is seated on the seat surface of the valve hole in the partition wall, on that side thereof which faces the pump chamber. Accordingly, the high pressure inside the pump chamber cannot be applied directly to the stack, so that the piezoelectric elements, for use as the components of the stack, can be prevented from being damaged by such a pressure.

DETAILED DESCRIPTION OF THE PREFERRED EMBODIMENTS

Figure 1:
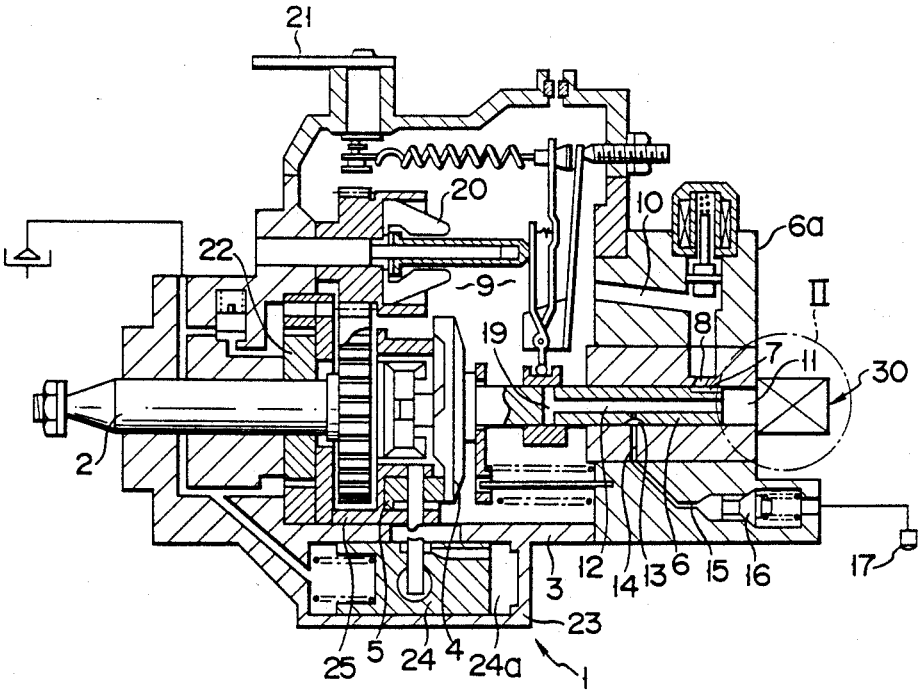
FIG. 1 is a sectional view of a fuel injection pump having a pilot injection system according to an embodiment of the present invention.

Referring now to FIG. 1, there is shown a fuel injection pump having therein a pilot injection system according to an embodiment of the present invention. In this embodiment, the pump is a distributor-type injection pump. Since the construction and functions of the pump of this type are well-known, the pump will be described only briefly.

The fuel injection pump has housing 3 in which fuel chamber 9 is defined. Driving shaft 2 is rotatably supported by housing 3. Shaft 2 is rotated by means of an engine (not shown). Plunger 6 is connected to shaft 2 by means of a coupling, face cam 4, and cam rollers 5 adapted to cooperate with cam 4. The plunger is inserted into pump cylinder 6*a*, which is attached to housing 3. Pump chamber 11 is defined in cylinder 6*a* by plunger 6.

Suction grooves 7, as many as the cylinders of the engine, are formed on the distal end portion of plunger 6, at regular intervals in the circumferential direction. Vertical hole 12, which extends axially in plunger 6, is connected to pump chamber 11. Also, hole 12 is connected to distribution port 13 which opens on the outer peripheral surface of plunger 6.

When face cam 4 rotates together with driving shaft 2, plunger 6 reciprocates a number of times equivalent to the number of engine cylinders, while making one revolution. When one of suction grooves 7 is connected to suction port 8 of pump cylinder 6*a*, during a fuel-suction stroke such that plunger 6 moves to the left of FIG. 1, fuel in fuel chamber 9 is fed into pump chamber 11 through port 8 and groove 7 connected thereto.

Thereafter, when a pressurization stroke is performed such that plunger 6 moves to the right of FIG. 1, the fuel in pump chamber 11 is pressurized by plunger 6. Then, plunger 6 is rotated only through a predetermined angle, so that distribution port 13 is connected to one of discharge holes 14 in pump cylinder 6*a*. At this point of time, the pressurized fuel in chamber 11 is supplied to one of injection nozzles 17 via hole 14, delivery passage 15, and delivery valve 16. Thus, a fuel-injection stroke is effected. FIG. 1 shows only one fuel-injection passage, which extends from discharge hole 14 to the one injection nozzle. Actually, however, there are injection passages as many as the engine cylinders.

Spill port 19, which is formed inside plunger 6, is connected to vertical hole 12. In the aforementioned fuel-injection stroke, that is, in a process such that plunger 6 moves to the right of FIG. 1, spill port 19 is exposed from spill ring 18 and connected to fuel chamber 9. Thereupon, the fuel pressure inside pump chamber 11 drops sharply. Thus, the fuel-injection stroke ends at the point of time when port 19 is connected to chamber 9.

Spill ring 18 is mounted on the outer peripheral surface of plunger 6 so as to be slidable in the axial direction of the plunger. By adjusting the axial position of ring 18 on plunger 6, therefore, the end time of the fuel-injection stroke, that is, the injection quantity of fuel from the fuel injection pump, can be regulated. More specifically, the axial position of spill ring 18, as is generally known, can be controlled by means of adjusting lever 21, which is operated in association with centrifugal governor 20 and an accelerator pedal (not shown). Ring 18 is coupled to governor 20 and lever 21 by means of link levers 20*a* and 21*a*, respectively.

Fuel in a fuel tank is fed into fuel chamber 9 by means of feed pump 22. Driven by driving shaft 2, pump 22 supplies chamber 9 with fuel at a pressure which corresponds to the operating state of the engine.

The fuel injection pump is further provided with a timer, which has timer cylinder 23. In FIG. 1, cylinder 23 is shown as extending parallel to the axis of plunger 6. It is to be noted, however, that the axis of cylinder 23 actually extends at right angles to plunger 6. Timer piston 24 in timer cylinder 23 is moved in accordance with the pressure of the fuel in fuel chamber 9, which is introduced into working chamber 24*a*. Piston 24 is connected to cam ring 25 by means of a coupling rod. Cam rollers 5 are retained by ring 25, which is supported on the inner wall of housing 3 so as to be rotatable around the axis of driving shaft 2. As timer piston 24 moves, therefore, the rotational phase angle of cam ring 25 changes. Thus, the fuel-injection timing can be controlled in accordance with the operating state of the engine.

Figure 2:
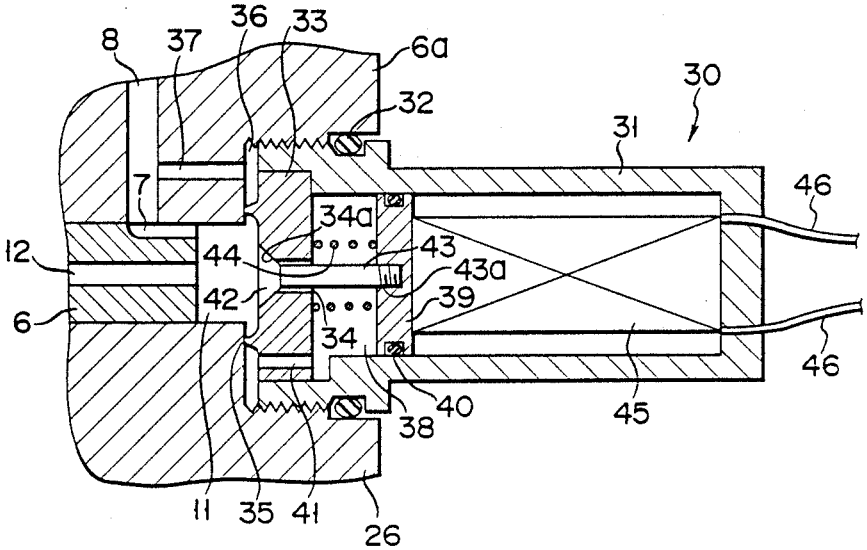
FIG. 2 is a sectional view of the pilot injection system indicated by circle II in FIG. 1.

Pump cylinder 6*a* is fitted with pilot injection system 30 according to the present invention. As shown in FIG. 2, system 30 has cylindrical casing 31, which is screwed coaxially in pump cylinder 6*a*. O-ring 32 for sealing is provided between casing 31 and cylinder 6*a*.

Partition wall 33 is fixed to the inner end of casing 31. Ring-shaped projection 35 is formed on that end face of wall 33 which is opposed to pump chamber 11. Projection 35 engages pump housing 6a in a liquid-tight manner. Thus, as seen from FIG. 2, pump chamber 11 is defined by plunger 6, on the one side, and by partition wall 33 having projection 35, on the other side. Annular chamber 36 is defined outside projection 35. It is connected to suction port 8 by means of passage 37.

Valve hole 34 is bored through partition wall 33, so as to be coaxial with plunger 6a. Thus, pump chamber 11 can communicate with the inside of casing 31 by means of hole 34. That portion of valve hole 34 situated on the side of chamber 11 constitutes valve seat 34a, having the form of a conical surface such that the diameter of hole 34 decreases with distance from chamber 11.

Valve plug 42 is located in valve hole 34. It can close hole 34, in cooperation with valve seat 34a. Thus, as seen from FIG. 2, plug 42 is conical in shape, and is formed integrally with rod 43. Rod 43 passes through valve hole 34, so as to leave an annular space around it, and projects into casing 31.

A movable wall or piston 39, having seal 40 thereon, is movably disposed in casing 31, and divides the inside of casing 31 into two liquid-tight chambers. The piston is coupled to rod 43 of valve plug 42. In this embodiment, screw portion 43a is formed on the distal end of rod 43, and plug 42 is connected to piston 39 by screwing rod 43 into the piston.

Return spring 44 is shaped as a coil spring and located in one of the chambers inside casing 31, that is, fuel-spill chamber 38 defined between partition wall 33 and piston 39. Surrounding rod 43, spring 44 urges piston 39 to the right of FIG. 2. Thus, valve plug 42 is urged to close valve hole 34. Spill chamber 38 communicates with annular chamber 36 by means of passage 41, which is bored through wall 33.

Stack 45, including a plurality of piezoelectric elements, is located in the other chamber, which may be termed a holding chamber, of casing 31. The stack is coupled to piston 39. More specifically, stack 45 is composed of several tens of piezoelectric elements and electrode plates stacked alternately in layers. Electrode plates are connected to a power source (not shown) by means of lead wires 46. In this embodiment, stack 45 has a characteristic such that it stretches axially when supplied with voltage.

When pilot injection system 30 is assembled as shown in FIG. 2, the width of the axial gaps between the piezoelectric elements of stack 45 is equal to 10 to 15% of that in a state such that neither voltage nor external compressive force is applied to the stack. The state of stack 45 shown in FIG. 2 is attained by pressing the stack with a force of 50 to 100 kg, by means of return spring 44 acting on piston 39. Such a compressive force on stack 45 can be adjusted by varying the depth of engagement between piston 39 and rod 43 screwed therein. If stack 45 is compressed continually in this manner, valve plug 42 is pressed against valve seat 34a with a predetermined sealing force. Even if the fuel in pump chamber 11 is not pressurized, therefore, chamber 11 and spill chamber 38 can be sealed or isolated securely from each other.

The sealing force on valve plug 42 can be adjusted by interposing shims of different thicknesses between piston 39 and stack 45.

Thus, if voltage is applied to stack 45 in which the axial gaps between the piezoelectric elements are adjusted as aforesaid, the stack is further stretched axially after the gaps between the elements are filled.

The operation of pilot injection system 30 will now be described. If voltage is applied to stack 45 when the fuel injection pump performs the fuel-injection stroke so that the fuel starts to be injected from injection nozzle 17, stack 45 extends instantaneously in the axial direction, against the urging force of return spring 44.

The extension of stack 45 causes valve plug 42 to be lifted from valve seat 43 by piston 39 and rod 43, thereby opening valve hole 34. Accordingly, the pressurized fuel in pump chamber 11 escapes through hole 34 into spill chamber 38. As a result, the fuel pressure in chamber 11 drops below the opening pressure of injection nozzle 17. Thereupon, the fuel temporarily ceases to be injected from nozzle 17. Thus, pilot fuel injection is effected as indicated by curve (a) in FIG. 3.

The fuel transferred from pump chamber 11 to spill chamber 38 is returned to suction port 8 via passage 41, annular chamber 36, and passage 37.

If the voltage supply to stack 45 is stopped after desired pilot injection (a) is accomplished, the stack contracts to its original length. Such contraction of stack 45 is accelerated by the urging force of return spring 44. Thus, as piston 39 and rod 43 are returned, valve plug 42 is seated on valve seat 34a, thereby closing valve hole 34.

Thereafter, as plunger 6 moves, the fuel in pump chamber 11 starts again to be pressurized. When the fuel pressure in chamber 11 exceeds the valve opening pressure of injection nozzle 17, the fuel starts to be injected from nozzle 17. Thus, main fuel injection is effected as indicated by curve (b) in FIG. 3.

Thereafter, spill port 19 of plunger 6 is opened in the aforesaid manner. Thus, the fuel-injection stroke ends.

The aforementioned pilot injection is performed in a low-speed operation, such as idling, of a diesel engine.

Figure 3:
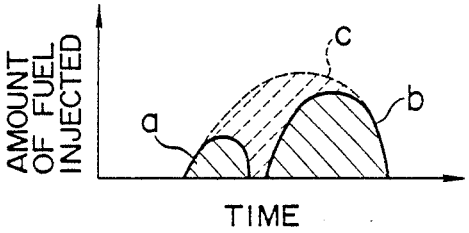
FIG. 3 shows curves representing the injection characteristics of the fuel injection pump of FIG. 1.

When the engine is operating at high speed, on the other hand, the normal fuel injection can be effected, as indicated by curve (c) in FIG. 3, by stopping the voltage supply to stack 45.

In pilot injection system 30 described above, stack 45 can be extended or contracted quickly, so that valve plug 42 can be operated at high speed. The fuel in pump chamber 11 immediately runs out into spill chamber 38 when valve plug 42 is lifted in order to open valve hole 34. Accordingly, the fuel pressure in chamber 11 can be lowered quickly. In other words, according to system 30 of the present invention, the reduction of the fuel pressure in chamber 11 can be effected by operating valve plug 42 so as to open valve hole 34, without regard to the degree of extension or contraction of stack 45. Thus, the pilot injection can be accomplished securely and quickly.

The response time of stack 45 is several hundreds of microseconds. Therefore, the response speed of stack 45 is much faster than the speed of increase of the fuel pressure in pump chamber 11, during the fuel-injection stroke. This also ensures stable pilot injection, and facilitates adjustment of the pilot-injection timing.

When voltage is applied to stack 45, the force of extension of the stack is great enough to lift valve plug 42, against the high pressure in pump chamber 11 and the urging force of return spring 44.

While pilot injection system 30 is not operating, valve hole 34 is closed by valve plug 42. In this state, therefore, the fuel pressure in pump chamber 11 never influences the internal pressure of spill chamber 38. Moreover, most of the fuel pressure in chamber 11, which acts on valve plug 42, is applied to partition wall 33, so that no substantial compressive force can be applied to stack 45. Thus, the individual piezoelectric elements of stack 45 cannot be subjected to or damaged by any excessive stress.

Since high voltage is applied to stack 45, water, however little, may possibly cause an electric leak, if it enters the chamber in which stack 45 is housed. However, the holding chamber for stack 45 is isolated securely from the fuel, which can be moist, in spill chamber 38.

Figure 4:
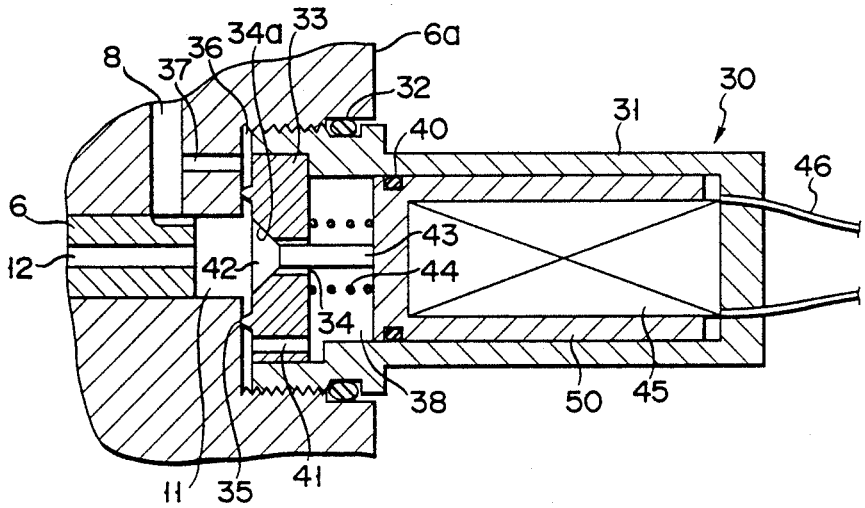
FIGS. 4 and 5 are sectional views of pilot injection systems according to alternative embodiments of the invention.
Figure 5:
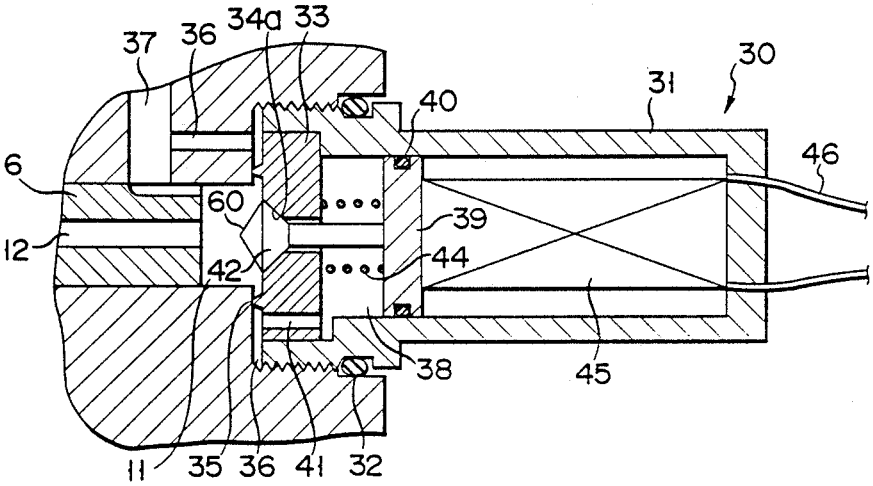

The present invention is not limited to the embodiment described above. FIGS. 4 and 5 show alternative embodiments of the invention. In the description of these embodiments to follow, like reference numerals are used to designate like portions or members as included in the first embodiment, for simplicity of illustration. In the embodiment shown in FIG. 4, piston 50 is tumbler-shaped so that it can contain stack 45 therein. If stack 45 is thus held in piston 50, the piezoelectric elements of stack 45 cannot suffer misalignment, and can therefore be prevented more securely from being damaged.

In the embodiment shown in FIG. 5, conical projection 60 is formed on that surface of valve plug 42 on the pump-chamber side, so as to project into pump chamber 11. According to such an arrangement, the fuel pressure in chamber 11 can better be received by partition wall 33 through valve plug 42. Thus, the compressive force on stack 45 can be reduced further.

What is claimed is:

1. A pilot injection system for a fuel injection pump, which has a pump chamber and supplies a pressurized fuel in the pump chamber to a combustion chamber of an internal combustion engine through an injection nozzle, comprising:

a casing attached to the fuel injection pump, the inside of the casing communicating with the pump chamber of the pump;

a partition wall provided in the casing and dividing the pump chamber and the inside of the casing in a liquid-tight manner;

a movable wall disposed in the casing and dividing the inside of the casing between a fuel-spill chamber, situated closer to the pump chamber and connected to a low pressure, and a holding chamber situated farther from the pump chamber;

a valve unit for controlling the connection between the pump chamber and the fuel-spill chamber, the valve unit including a valve hole formed in the partition wall and connecting the pump chamber and the fuel-spill chamber, the valve hole having a seat surface facing the pump chamber, a valve plug adapted to be seated on the seat surface, thereby closing the valve hole, a coupling rod attached to the valve plug, extending through the valve hole into the fuel-spill chamber, and coupled to the movable wall, and a coil spring located between the movable wall and the partition wall and pressing the movable wall toward the holding chamber, whereby the valve plug is seated on the seat surface of the valve hole, by means of the movable wall and the coupling rod, urged by the coil spring, the coupling rod including means for adjusting a distance between the valve plug and the movable wall; and actuator means disposed in the holding chamber of the casing for operating the valve plug, the actuator including a stack of piezoelectric elements, coupled to the movable wall and capable of extending or contracting in accordance with a voltage applied to each piezoelectric element, so that the valve plug may be lifted from the seat surface of the valve hole, against the urging force of the coil spring, through the medium of the movable wall and the rod, when the stack extends, whereby the adjusting means and the coil spring provide both a predeterminable preload on the piezoelectric elements and a predeterminable sealing force on the valve plug.

2. The pilot injection system according to claim 1, wherein the seat surface of the valve hole of the valve unit comprises a female conical shape defined in said partition wall about said valve hole, and the valve plug has an end face, opposed to the pump chamber, and a male, conical peripheral surface for mating with the seat surface.

3. The pilot injection system according to claim 2, wherein the end face of the valve plug is flat.

4. The pilot injection system according to claim 2, wherein the end face of the valve plug has the form of a cone projecting into the pump chamber.

5. The pilot injection system according to claim 1, wherein the coupling rod is fixed, at one end thereof, to the valve plug, and said adjusting means includes a screw portion formed on the other end portion of said coupling rod, the screw portion being screwed in a tapped hole in that surface of the movable wall which defines the fuel-spill chamber.

6. The pilot injection system according to claim 1, wherein the movable wall is fitted, on the outer peripheral surface thereof, with a ring-shaped seal in sliding contact with the inner surface of the casing, the seal dividing the holding chamber and the fuel-spill chamber of the casing in a liquid-tight manner.

7. Apparatus according to claim 1, wherein said coil spring is positioned so as to be substantially coaxial with said coupling rod.

* * * * *